US009862560B2

(12) United States Patent
Ishibashi et al.

(10) Patent No.: US 9,862,560 B2
(45) Date of Patent: Jan. 9, 2018

(54) TENSION CONTROL DEVICE

(71) Applicant: IHI Corporation, Tokyo (JP)

(72) Inventors: Mareto Ishibashi, Tokyo (JP); Yoshiyuki Wada, Tokyo (JP); Kensuke Hirata, Tokyo (JP); Rui Oohashi, Tokyo (JP)

(73) Assignee: IHI CORPORATION, Tokyo (JP)

( * ) Notice: Subject to any disclaimer, the term of this patent is extended or adjusted under 35 U.S.C. 154(b) by 0 days.

(21) Appl. No.: 15/198,590

(22) Filed: Jun. 30, 2016

(65) Prior Publication Data

US 2016/0311639 A1 Oct. 27, 2016

Related U.S. Application Data

(63) Continuation of application No. PCT/JP2015/063076, filed on May 1, 2015.

(30) Foreign Application Priority Data

May 28, 2014 (JP) ..... 2014-110531

(51) Int. Cl.
*B65H 23/24* (2006.01)
*B65H 23/32* (2006.01)

(52) U.S. Cl.
CPC ..... *B65H 23/24* (2013.01); *B65H 23/32* (2013.01); *B65H 2406/111* (2013.01); *B65H 2515/342* (2013.01)

(58) Field of Classification Search
CPC ..... B65H 20/14; B65H 23/048; B65H 23/24; B65H 23/26; B65H 23/32; B65H 2406/111; B65H 2515/342
See application file for complete search history.

(56) References Cited

U.S. PATENT DOCUMENTS 6,471,152 B1 * 10/2002 Suzuki ..... B65H 23/048 226/118.3
2011/0198378 A1 8/2011 Chang et al.

FOREIGN PATENT DOCUMENTS

| | | | |
|---|---|---|---|
| CN | 101603244 | A | 12/2009 |
| CN | 103086178 | A | 5/2013 |
| JP | 5-155488 | A | 6/1993 |
| JP | 6-40631 | A | 2/1994 |
| JP | 8-26543 | A | 1/1996 |
| JP | 2554806 | B2 | 11/1996 |
| JP | 9-295729 | A | 11/1997 |
| JP | 10-72156 | A | 3/1998 |
| JP | 10-170364 | A | 6/1998 |
| JP | 2001-286809 | A | 10/2001 |
| JP | 4314435 | B2 | 8/2009 |
| JP | 2011-168403 | A | 9/2011 |
| TW | 201130728 | A1 | 9/2011 |

* cited by examiner

*Primary Examiner* — William E Dondero
(74) *Attorney, Agent, or Firm* — Rothwell, Figg, Ernst & Manbeck, P.C.

(57) ABSTRACT

The present disclosure is a tension control device which includes a pressing member configured to press an object in a noncontact manner by spraying a gas onto the object to which tension is applied, an actuator configured to vary a position of the pressing member, a pressure sensor configured to detect pressure of the gas, a gap sensor configured to detect a floating amount of the object from the pressing member, and a control unit configured to control the actuator based on a detected value of the pressure sensor and a detected value of the gap sensor.

7 Claims, 6 Drawing Sheets

TENSION CONTROL DEVICE

CROSS-REFERENCE TO RELATED APPLICATIONS

The present application is a continuation application of International Application No. PCT/JP2015/063076, filed May 1, 2015, which claims priority to Japanese Patent Application No. 2014-110531, filed May 28, 2014. The contents of these applications are incorporated herein by reference in their entirety.

TECHNICAL FIELD

The present disclosure relates to a tension control device.

BACKGROUND

Patent Document 1 discloses a conveyor device which continuously travels and conveys a belt-like web (a workpiece). The conveyor device includes a floater configured to change a movement direction of the web while floating it (a noncontact state) using air, an actuator configured to move the floater in a direction perpendicular to a conveyance direction of the web, and a pressure sensor configured to detect pressure between the web and the floater and applies tension to the travelling web by controlling the actuator based on a detection result of the pressure sensor.

DOCUMENTS OF THE PRIOR ART

Patent Documents

[Patent Document 1]
Japanese Unexamined Patent Application, First Publication No. 2001-286809

SUMMARY

A technique of applying tension to the workpiece in the conventional conveyor device includes adjusting a position of the floater in the direction perpendicular to the conveyance direction of the workpiece based on the pressure between the workpiece and the floater, and thus it is difficult to performing high-precision tension control. High-precision (fine) tension control is required in order to avoid damaging the workpiece when the workpiece inevitably becomes relatively weak due to the workpiece becoming thinner, or the like.

Also, when the workpiece is intermittently transferred, excessive tension is likely to be applied to the workpiece at the time of a state change in which the workpiece is changed from a travelling state to a stopped state or from a stopped state to a travelling state. For this reason, it is necessary to avoid application of excessive tension to the workpiece by realizing higher precision tension control during the intermittent transfer in the case of a relatively weak workpiece. As described above, when the relatively weak workpiece is conveyed, accuracy of tension control is insufficient in a conventional technique of applying tension, and thus it is preferable to realize higher precision tension control.

The present disclosure was made in view of the above-described problems, and an aspect of the present disclosure is for the purpose of realizing higher precision tension control than the related art.

In order to accomplish the above-described objects, in the present disclosure, a tension control device includes a pressing member configured to press an object in a noncontact manner by spraying a gas onto the object to which tension is applied, an actuator configured to vary a position of the pressing member, a pressure sensor configured to detect pressure of the gas, a gap sensor configured to detect a floating amount of the object from the pressing member, and a control unit configured to control the actuator based on a detected value of the pressure sensor and a detected value of the gap sensor.

According to the present disclosure, the actuator is controlled based on the detected value of the pressure sensor configured to detect the pressure of the gas and the detected value of the gap sensor configured to detect the floating amount of the object from the pressing member. Thus, it is possible to realize higher precision tension control than when only pressure is detected in the related art.

DETAILED DESCRIPTION

Figure 1:
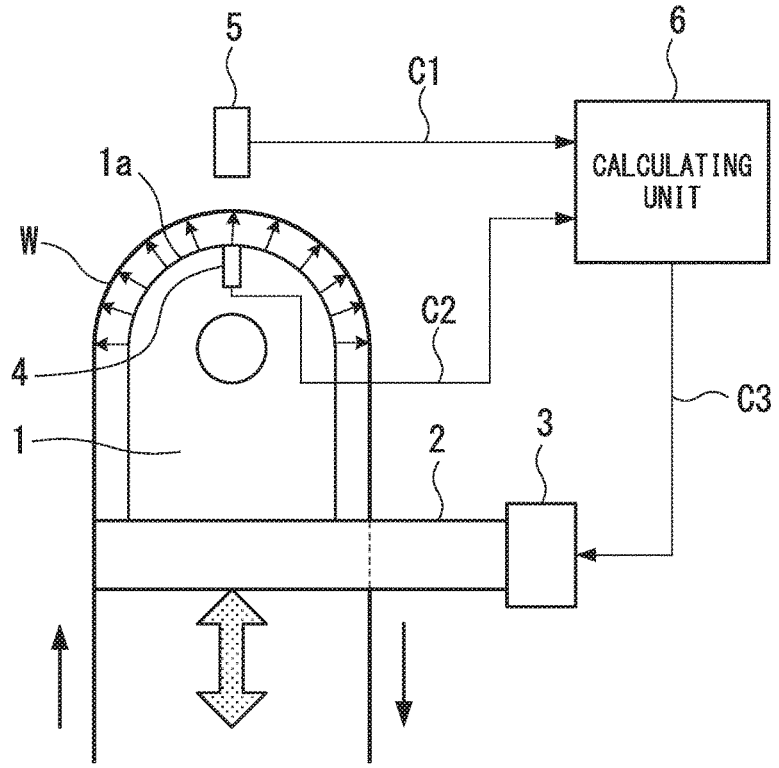
FIG. 1 is a block diagram showing a functional constitution of a tension control device related to an embodiment of the present disclosure.

Hereinafter, an embodiment of the present disclosure will be described with reference to the drawings. A tension control device related to the embodiment includes an air turn bar 1 (a pressing member), a coupling member 2, a ball screw 3 (an actuator), a pressure sensor 4, a gap sensor 5, and a calculating unit 6 (a control unit) as shown in FIG. 1.

The tension control device has a member having a belt shape and travelling in a longitudinal direction (a belt-like member W) as an object to which tension is applied. The belt-like member W is a thin sheet with a predetermined width made of, for example, a resin or glass and is conveyed to travel in a longitudinal direction perpendicular to a width direction.

The air turn bar 1 is a pressing member configured to apply desired tension to the belt-like member W by pressing the belt-like member W in a noncontact manner. In other words, the air turn bar 1 presses the belt-like member W in the noncontact manner by spraying a portion of the belt-like member W travelling in the longitudinal direction with air from a guide surface 1*a* curved in a circular arc shape. The guide surface 1*a* is curved about an axis perpendicular to a travelling direction of the belt-like member W and is a circular arc surface (a cylindrical surface) having a width larger than a width of the belt-like member W.

In this air turn bar 1, the belt-like member W is held in a state in which it is curved and folded with respect to the guide surface 1*a* as shown in the drawing. Note that, in the air turn bar 1, the belt-like member W may be sprayed with another gas (for example, an inert gas such as a nitrogen gas) rather than air.

The coupling member 2 is a member of a predetermined shape coupled to the air turn bar 1 and couples the air turn bar 1 to the ball screw 3. The ball screw 3 is an actuator configured to vary a position of the air turn bar 1. In other words, the ball screw 3 linearly moves the air turn bar 1 coupled via the coupling member 2. Since a ball screw is generally well known as an actuator, a description of a detailed constitution thereof is omitted. But, the ball screw 3 reciprocates (vertically move) the air turn bar 1 coupled to a female screw section meshed with a rod-shaped male screw section via the coupling member 2 in directions indicated by arrows by rotating the male screw section.

The pressure sensor 4 is provided inside the air turn bar 1, that is, at an opposite side of the belt-like member W in between the guide surface 1*a* and detects pressure of air sprayed toward the belt-like member W from the guide surface 1*a* of the air turn bar 1 as air pressure P. The pressure sensor 4 outputs a detected value indicating the air pressure P to the calculating unit 6. The gap sensor 5 is provided to face the guide surface 1*a* in between the belt-like member W and detects a floating amount of the belt-like member W from the air turn bar 1, that is, a gap width between the guide surface 1*a* and the belt-like member W serving as a floating gap d. The gap sensor 5 outputs a detected value indicating the floating gap d to the calculating unit 6.

The calculating unit 6 is a control unit configured to perform feedback control on the ball screw 3 based on the detected value indicating the air pressure P and the detected value indicating the floating gap d. The calculating unit 6 is a software control device configured to calculate an operation amount of the ball screw 3 by performing information processing on the air pressure P and the floating gap d that are controlled variables based on a control program stored in advance.

The calculating unit 6 calculates a proportional integral derivative controller (PID) operation amount by performing information processing on the air pressure P and the floating gap d based on, for example, a PID control algorithm. Also, the calculating unit 6 performs feedback control of tension applied to the belt-like member W by the air turn bar 1 by supplying the PID operation amount to the ball screw 3 to adjust a position of the ball screw 3.

Next, an operation of the tension control device with such a constitution will be described in detail with reference to FIGS. 2 and 3.

Relationships of the tension T applied to the belt-like member W by the air turn bar 1 with the air pressure P and the floating gap d will be first described with reference to FIG. 2. As shown in FIG. 2, the air pressure P is proportional to the tension T. In other words, the air pressure P increases linearly as the tension T increases.

On the other hand, the floating gap d represents a reverse change of the air pressure P. In other words, the floating gap d is reduced non-linearly as the tension T increases. Also, a rate of change (a slope) is large at a region at which the tension T is relatively small, and the rate of change (the slope) is small at a region at which the tension T is relatively large as tendencies of a change of the floating gap d.

The tension control device related to the embodiment performs the feedback control of the tension applied to the belt-like member W by adjusting the position of the ball screw 3 using such relationships of the tension T with the air pressure P and the floating gap d. In other words, the tension control device controls the tension of the belt-like member W to maintain desired target tension (a target value) by outputting an actuator instruction A1 or an actuator instruction A2 generated according to a procedure indicated in a flowchart of FIG. 3 to the ball screw 3.

The calculating unit 6 of the tension control device regularly acquires the detected value (a pressure detection value) of the air pressure P output by the pressure sensor 4 and the detected value (a gap detection value) of the floating gap d output by the gap sensor 5 at a predetermined time interval. To be more specific, if the calculating unit 6 acquires the pressure detection value (step S1), the calculating unit 6 calculates the PID operation amount P1 based on the pressure detection value (step S2). Also, the calculating unit 6 acquires the gap detection value (step S3) and calculates a PID operation amount P2 based on the gap detection value (step S4).

The calculating unit 6 determines whether the pressure detection value is greater than a pressure threshold value stored therein in advance (step S5). When a result of the determination is "Yes," the actuator instruction A1 based on the PID operation amount P1 is output to the ball screw 3, and when the result of the determination is "No," the actuator instruction A2 based on the PID operation amount P2 is output to the ball screw 3.

Figure 2:
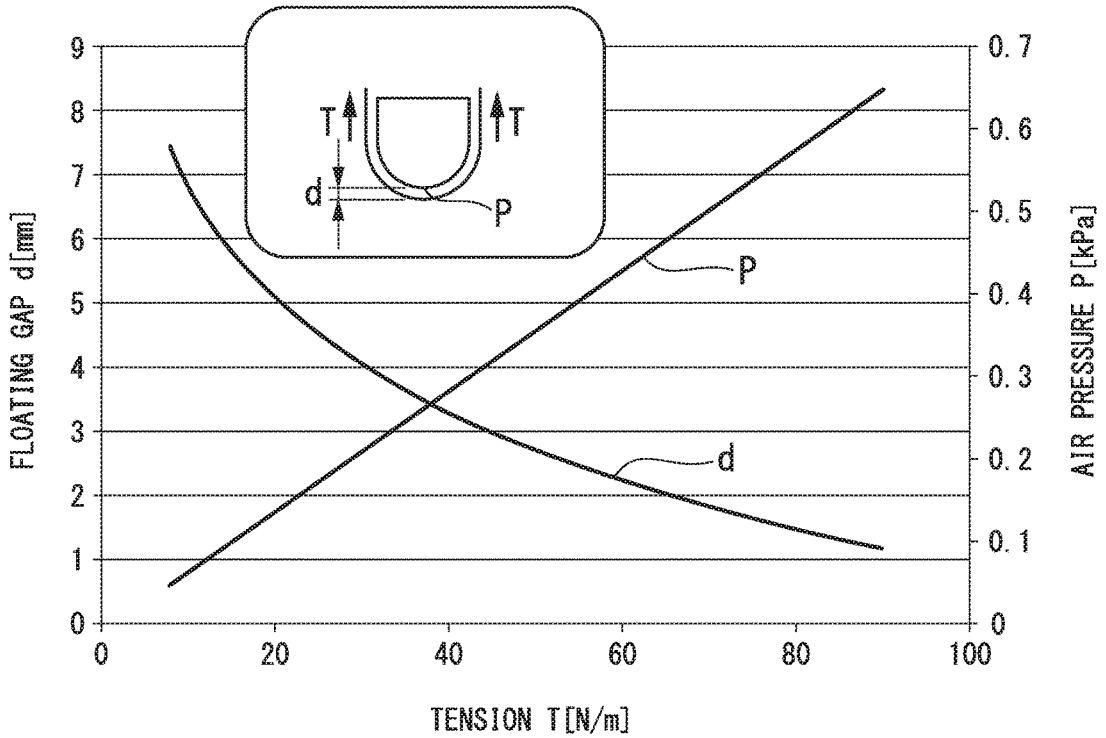
FIG. 2 is a characteristic diagram showing relationships of tension of a belt-like sheet with air pressure and a floating gap in the tension control device related to the embodiment of the present disclosure.

Here, as shown in FIG. 2, although the rate of change of the air pressure P is constant, the rate of change of the floating gap d is decreased as the tension increases. In addition, magnitude relationships of the rate of change of the air pressure P and the rate of change of the floating gap d are reversed at a specific air pressure P or floating gap d. The pressure threshold value corresponds to the air pressure P in which the magnitude relationships of the rate of change of the air pressure P and the rate of change of the floating gap d are reversed.

In other words, when the pressure detection value is greater than the pressure threshold value, that is, the rate of change of the air pressure P is greater than the rate of change of the floating gap d, the PID operation amount P1 is higher in control sensitivity than the PID operation amount P2. On the other hand, when the pressure detection value is equal to or less than the pressure threshold value, that is, the rate of change of the floating gap d is equal to or greater than the rate of change of the air pressure P, the PID operation amount P2 is higher in control sensitivity than the PID operation amount P1.

Therefore, according to the tension control device related to the embodiment, the actuator instruction based on the PID operation amount having higher control sensitivity among the actuator instruction A1 based on the PID operation amount P1 and the actuator instruction A2 based on the PID operation amount P2 is output to the ball screw 3. Thus, it is possible to realize higher precision tension control than in the related art.

According to the tension control device related to the embodiment, since the actuator instruction A1 or the actuator instruction A2 is generated by alternatively selecting the PID operation amount P1 and the PID operation amount P2 which are already calculated and is output to the ball screw 3, the ball screw 3 can be rapidly controlled. Thus, it is possible to realize higher precision tension control than in the related art.

According to the tension control device related to the embodiment, the air turn bar 1 including the guide surface 1*a* curved about the axis perpendicular to the travelling direction of the belt-like member W and having the width larger than the width of the belt-like member W is provided. Thus, stable tension can be applied to the belt-like member W.

Also, according to the tension control device related to the embodiment, the pressure sensor 4 provided at the opposite side of the belt-like member W in between the guide surface 1*a* and the gap sensor 5 provided to face the guide surface 1*a* in between the belt-like member W are provided. Thus, the air pressure P and the floating gap d can be accurately detected.

According to the tension control device related to the embodiment, the ball screw 3 is used as the actuator. Thus, the tension control device with excellent durability can be provided.

The present disclosure is not limited to the above-described embodiments but is considered as including, for example, the following modified examples.

Figure 3:
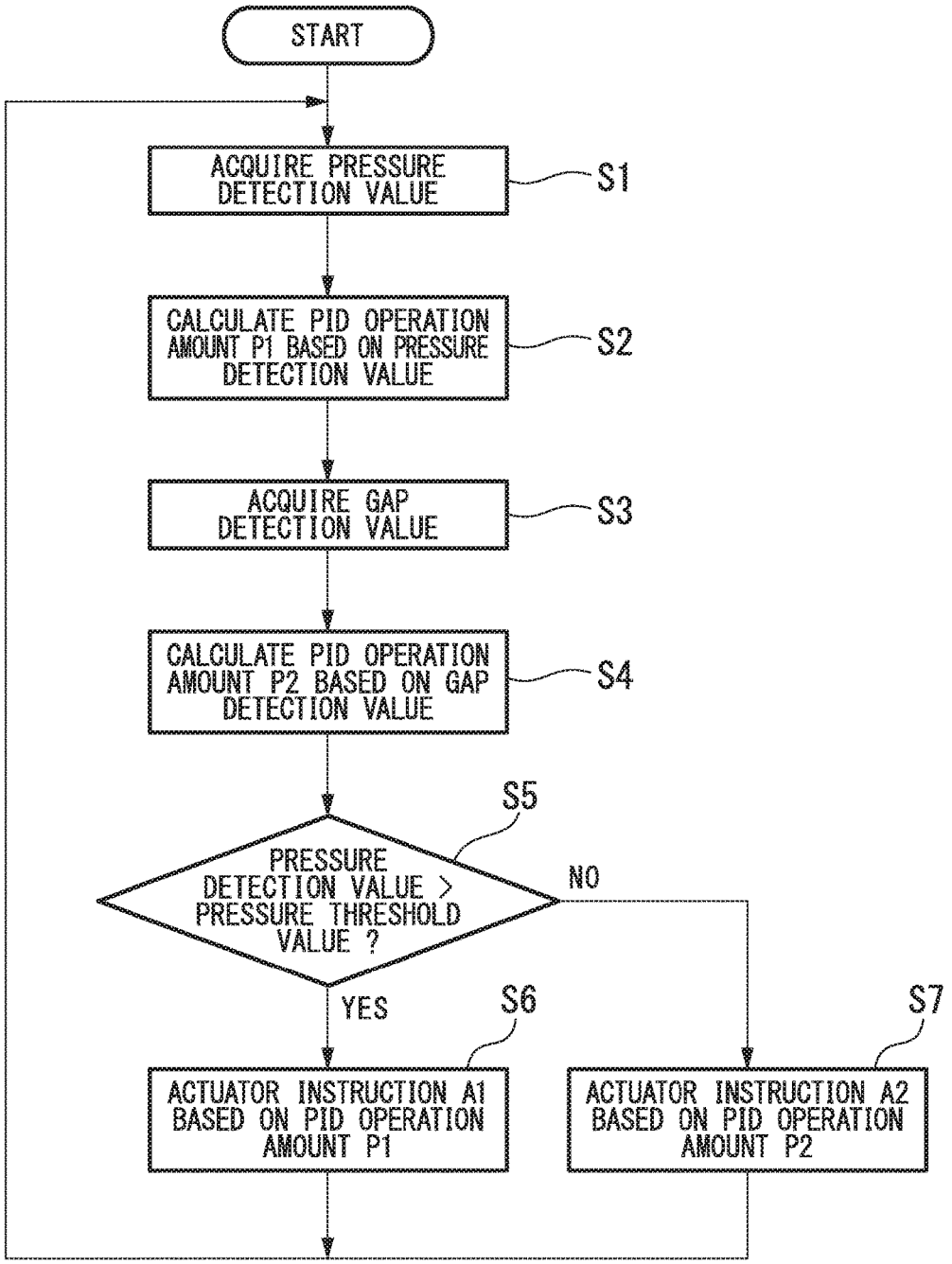
FIG. 3 is a first flowchart illustrating a control operation of the tension control device related to the embodiment of the present disclosure.
Figure 4:
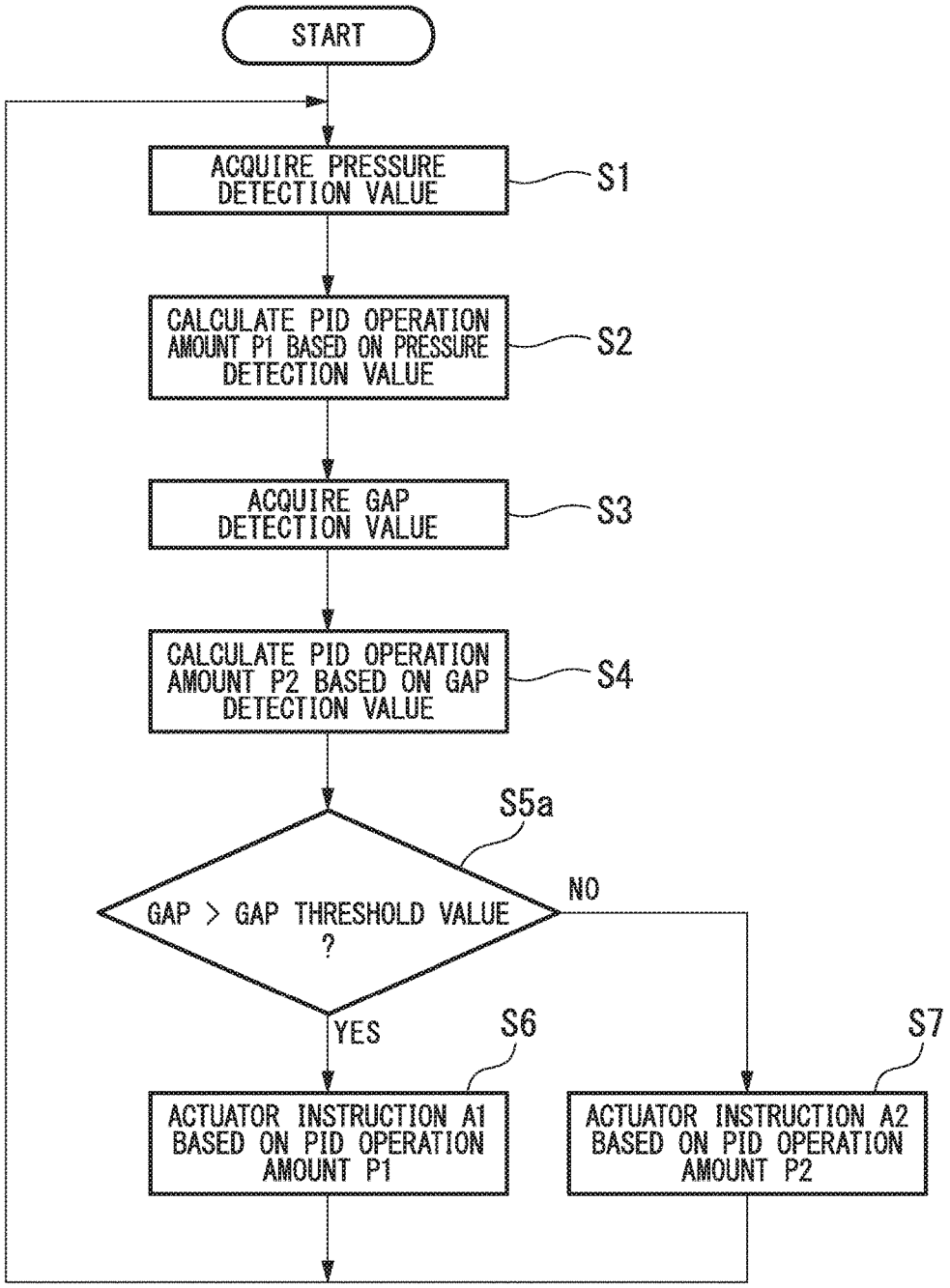
FIG. 4 is a second flowchart illustrating the control operation of the tension control device related to the embodiment of the present disclosure.

(1) The procedure indicated in the flowchart of FIG. 3 has been described as an example of a control process of the calculating unit 6 in the above-described embodiments, but the present disclosure is not limited thereto. For example, the calculating unit 6 may execute step S5*a* indicated in a flowchart of FIG. 4 rather than step S5 of FIG. 3. In other words, the gap detection value may be compared with the gap threshold value rather than comparing the pressure detection value with the pressure threshold value.

The gap threshold value in this case corresponds to the floating gap d in which the magnitude relationships of the rate of change of the air pressure P and the rate of change of the floating gap d are reversed. The actuator instruction based on the PID operation amount having higher control sensitivity among the actuator instruction A1 based on the PID operation amount P1 and the actuator instruction A2 based on the PID operation amount P2 is output to the ball screw 3 as in the control process of FIG. 3 even by means of such a control process of FIG. 4. Thus, it is possible to realize higher precision tension control than in the related art.

Figure 5:
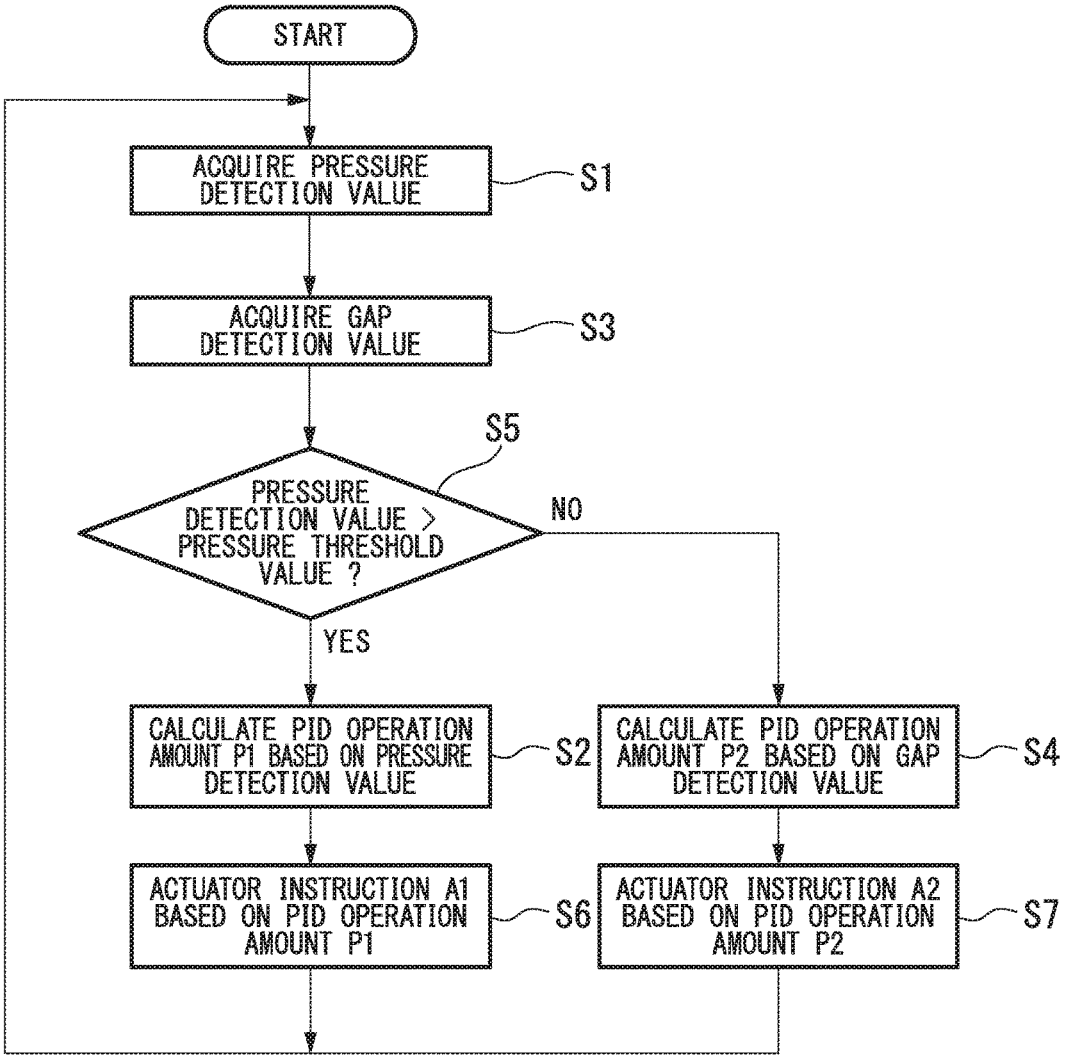
FIG. 5 is a third flowchart illustrating the control operation of the tension control device related to the embodiment of the present disclosure.

(2) Also, in the control process of the calculating unit 6, the order of steps S1 to S7 indicated in the flowchart of FIG. 3 may be changed as indicated in a flowchart of FIG. 5. In other words, steps S2 and S4 may be executed as a post-process of step S5 rather than being executed as a pre-process of step S5.

Figure 6:
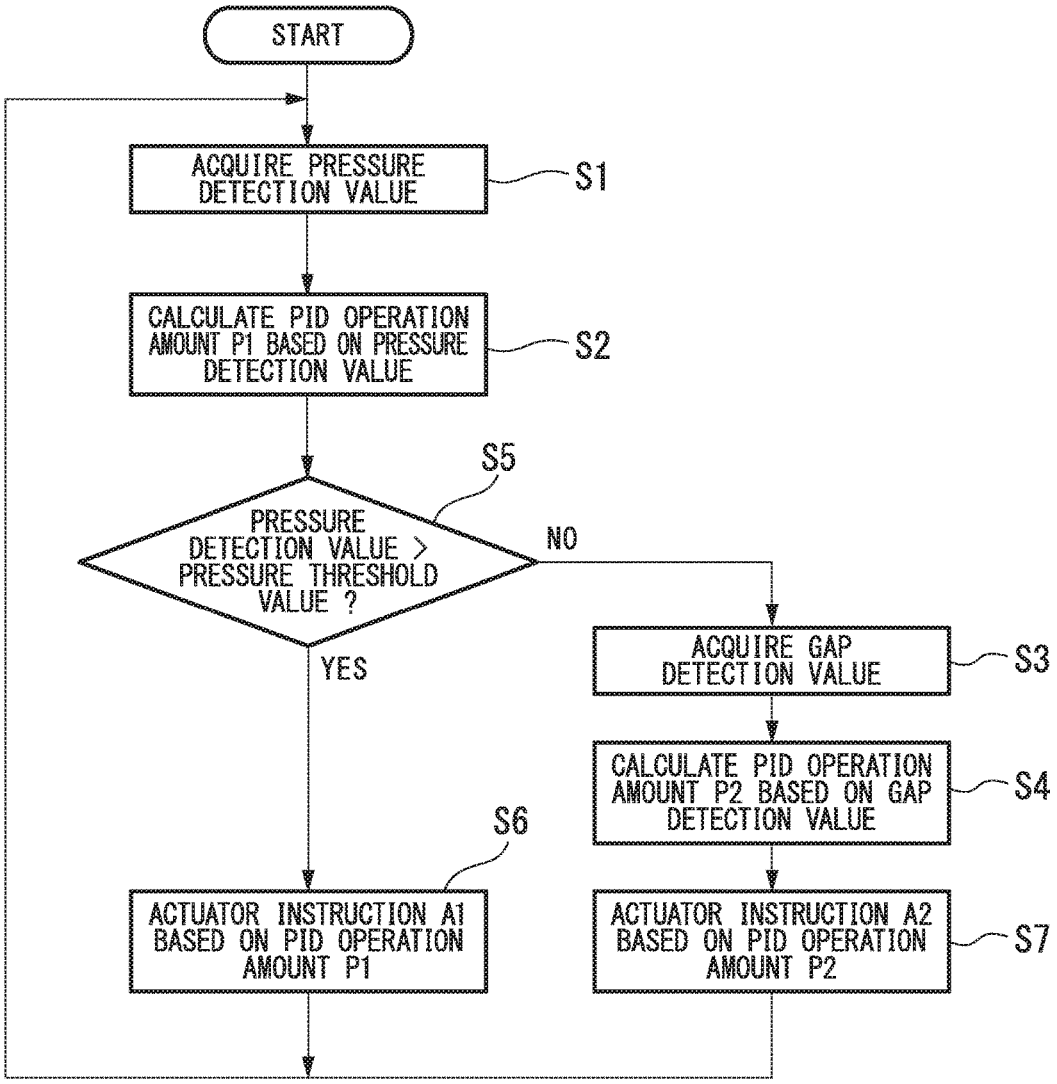
FIG. 6 is a fourth flowchart illustrating the control operation of the tension control device related to the embodiment of the present disclosure.

(3) Also, in the control process of the calculating unit 6, the order of steps S1 to S7 indicated in the flowchart of FIG. 3 may be changed as indicated in a flowchart of FIG. 6. In other words, steps S3 and S4 may be executed as a post-process of step S5 rather than being executed as a pre-process of step S5.

According to the present disclosure, the tension applied to the object by the pressing member is accurately adjusted by controlling the actuator using the gap sensor in addition to the pressure sensor used in the related art. Therefore, usage aspects of the detected value of the pressure sensor and the detected value of the gap sensor are not limited to the flowcharts of FIGS. 3 to 6.

Figure 7:
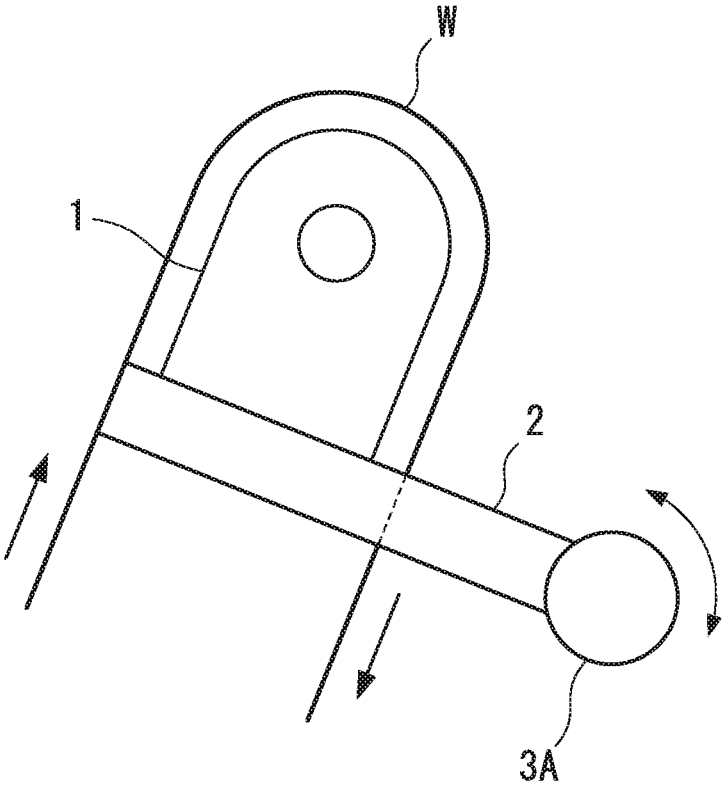
FIG. 7 is a schematic diagram showing a modified example of an actuator in the tension control device related to the embodiment of the present disclosure.

(4) The ball screw 3 is used as the actuator in the above-described embodiments, but the present disclosure is not limited thereto. For example, as shown in FIG. 7, a motor 3A may be used as the actuator for rotating (rotationally moving) the air turn bar 1 about a rotation axis. A servo motor capable of accurately setting the position of the air turn bar 1 is preferable as the motor 3A. Note that the actuator is not limited to the ball screw 3 or the motor 3A, and various existing actuators can be adopted as the actuator.

INDUSTRIAL APPLICABILITY

According to the present disclosure, the actuator is controlled based on a detected value of the pressure sensor configured to detect pressure of a gas and a detected value of the gap sensor configured to detect a floating amount of an object from the pressing member. Thus, it is possible to realize higher precision tension control than when only pressure is detected in the related art.

What is claimed is:

1. A tension control device comprising:

a pressing member configured to press an object in a noncontact manner by spraying a gas onto the object to which tension is applied;

an actuator configured to vary a position of the pressing member;

a pressure sensor configured to detect pressure of the gas;

a gap sensor configured to detect a floating amount of the object from the pressing member; and a control unit configured to control the actuator based on a detected value of the pressure sensor and a detected value of the gap sensor, wherein the control unit controls the actuator based on the detected value of the pressure sensor when the detected value of the pressure sensor is greater than a predetermined pressure threshold value or when the detected value of the gap sensor is greater than a predetermined gap threshold value and controls the actuator based on the detected value of the gap sensor when the detected value of the pressure sensor is equal to or less than the predetermined pressure threshold value or when the detected value of the gap sensor is equal to or less than the predetermined gap threshold value.

2. The tension control device according to claim 1, wherein the object is a member having a belt shape and travelling in a longitudinal direction, and the pressing member includes a guide surface curved about an axis perpendicular to a travelling direction of the object and having a width larger than a width of the object and sprays the gas toward the object from the guide surface.

3. The tension control device according to claim 2, wherein the pressure sensor is provided such that the guide surface is located between the pressure sensor and the object, and the gap sensor is provided such that the object is located between the gap sensor and the guide surface.

4. The tension control device according to claim 3, wherein the actuator is a ball screw configured to move the pressing member linearly or a motor configured to rotate the pressing member.

5. The tension control device according to claim 2, wherein the actuator is a ball screw configured to move the pressing member linearly or a motor configured to rotate the pressing member.

6. The tension control device according to claim 1, wherein the actuator is a ball screw configured to move the pressing member linearly or a motor configured to rotate the pressing member.

7. The tension control device according to claim 1, wherein the actuator is a ball screw configured to move the pressing member linearly or a motor configured to rotate the pressing member.

* * * * *